US005150536A

United States Patent [19]

Strong

[11] Patent Number: 5,150,536

[45] Date of Patent: Sep. 29, 1992

[54] WINTER WEATHER FOOTWEAR ARTICLE

[76] Inventor: Molly Strong, 205 South Ferndale Dr., Big Fork, Mont. 59911

[21] Appl. No.: 462,637

[22] Filed: Jan. 9, 1990

[51] Int. Cl.[5] ..... A43B 3/16

[52] U.S. Cl. ..... 36/7.10 R; 36/44

[58] Field of Search ..... 36/1.5, 7.1 R, 44, 138, 36/2 R, 43, 15, 25 R; 128/581

[56] References Cited

U.S. PATENT DOCUMENTS

| | | | |
|---|---|---|---|
| Re. 32,506 | 9/1987 | Hightower, Jr. | 36/2 R X |
| 205,837 | 7/1878 | Chase | 36/15 X |
| 384,155 | 6/1888 | Hathorn | 36/138 X |
| 476,499 | 6/1892 | Trimby | 36/44 X |
| 1,018,145 | 2/1912 | Weir | 36/15 |
| 1,228,720 | 6/1917 | Troutt | 36/15 X |
| 1,644,217 | 10/1927 | Wreford | 36/7.1 R |
| 2,435,668 | 2/1948 | Behringer | 36/15 X |
| 2,680,309 | 6/1954 | Peterson | 36/15 X |
| 2,685,141 | 8/1954 | Davenport | 36/7.6 |
| 2,718,715 | 9/1955 | Spilman | 36/11 X |
| 2,721,399 | 10/1955 | Emmer | 36/7.1 R |
| 2,799,951 | 7/1957 | Rogers | 36/7.1 R |
| 3,084,459 | 10/1960 | Colman | 36/7.1 R |
| 3,208,164 | 9/1965 | Hoyt, Jr. | 36/7.1 R |
| 3,574,958 | 4/1971 | Martuch | 36/84 X |
| 3,724,105 | 4/1973 | Weight | 36/44 |
| 3,736,673 | 6/1973 | Dubner | 36/44 |
| 3,863,272 | 2/1975 | Guille | 36/12 X |
| 3,968,577 | 7/1976 | Jackson | 36/43 |
| 4,023,281 | 5/1977 | Terry | 36/7.1 R |
| 4,062,131 | 12/1977 | Hsiung | 36/44 |
| 4,130,948 | 12/1978 | Krug | 36/44 |
| 4,187,621 | 2/1980 | Cohen | 36/44 |
| 4,217,704 | 8/1980 | Whitaker | 36/7.1 R |
| 4,359,783 | 11/1982 | Andrews | 36/4 X |
| 4,461,098 | 7/1984 | Diegelman | 36/7.1 R X |
| 4,461,099 | 7/1984 | Bailly | 36/44 |
| 4,489,510 | 12/1984 | Williams | 36/7.6 X |
| 4,516,336 | 5/1985 | Nissenbaum | 36/7.1 R |
| 4,597,196 | 7/1986 | Brown | 36/44 |
| 4,616,428 | 10/1986 | Leger | 36/7.1 R |
| 4,619,058 | 10/1986 | Gumbert | 36/102 |
| 4,642,912 | 2/1987 | Wildman et al. | 36/44 |
| 4,649,586 | 3/1987 | Wu | 36/44 X |
| 4,713,895 | 12/1987 | Vallieres | 36/7.1 R X |
| 4,782,605 | 11/1988 | Chapnick | 36/44 |
| 4,896,437 | 1/1990 | Johnson | 36/1.5 |
| 4,984,377 | 1/1991 | Schneider | 36/67 D X |

*Primary Examiner*—Paul T. Sewell
*Assistant Examiner*—Ted Kavanaugh

[57] ABSTRACT

A footwear article for winter weather conditions, worn as a boot, overboot or overshoe, having a flat, unitary sole piece constructed of Papermaker's Wet Felt which provides good traction over ice and snow surfaces. The footwear article may also have an insole having layers of closed-cell foam insulation and which is oversized compared to the foot of the wearer. The article may further have an upper. The sole piece, upper and other external surfaces are of breathable, light-weight materials.

18 Claims, 10 Drawing Sheets

WINTER WEATHER FOOTWEAR ARTICLE

The present invention relates to a footwear article which can be worn as a boot over socks or a bare foot, can be worn over shoes or can be worn over boots. The footwear article is specially adapted for wear in winter weather conditions, i.e. on snow and ice. The invention provides footwear which gives excellent traction over snow and ice due to the novel sole material used and to the expanded surface contact area provided by the design. It also provides good thermal insulation and warmth due to the breathability of materials used in its construction. Further, it is a lightweight footwear article and readily washable because of the materials used in its construction.

All previous footwear designed for winter's snow and ice has utilized hard, and heavy, waterproof materials on the sole and sometimes on the uppers as well. For instance, hard rubber soles are most commonly used for winter boots and overboots. These prior art boots and overboots, almost invariably, are molded or supplemented on the sole with some type of tread, studs, spikes, etc., to give the wearer traction on slippery surfaces such as snow and ice. Despite these efforts using many types of treaded soles, these types of boots or overboots are unsatisfactory in providing good traction. The use of hard rubber or leather materials in footwear also has disadvantages in insulating the foot of the wearer and keeping it warm. The non-breathability of these materials traps heat and moisture and salt from sweat generated by the foot of the wearer in the boot. The salt and water combination acts as a good conductor to conduct body heat out of the boot resulting in cold feet, which make the entire body feel colder.

Footwear boots having hard rubber or plastic soles are typified in U.S. Pat. No. 4,516,336.

The use of fibrous, soft materials for footwear soles is known. However, such footwear is generally designed for indoor or other light use. For example, use of leather as a sole material is well-known for moccasin-type footwear. U.S. Pat. Nos. 4,619,058 and 2,718,715. Further, fibrous materials are known to be useful as sole attachments to provide good traction for footwear used in floor cleaning applications and the like. U.S. Pat. Nos. 4,217,704 and 4,489,510. U.S. Pat. No. 2,685,141 discloses a fibrous material sole attachment for shoes to provide traction in ice and snow. However, the sole material used is a metallic, steel wool-type, material which has weight, insulation, corrosion and safety disadvantages.

It is the object of the present invention to provide a footwear article, used as a boot, overboot or overshoe, which gives good traction on ice and snow covered surfaces, has good insulating and warmth properties for the foot of the wearer, is lightweight and avoids the disadvantages of the prior footwear discussed above.

Applicant has achieved the above objectives through the invention described and claimed herein. Applicant has discovered, contrary to the belief in the art, that a winter weather footwear article having a pliable, breathable, non-waterproof, non-treaded, fibrous sole surface is advantageous in providing good traction on snow and ice covered surfaces and provides a warm and comfortable boot, overboot or overshoe. More particularly, applicant has discovered that a footwear article having a single flat layer sole constructed of a synthetic felt material woven by a needle punch technique is useful for winter weather footwear.

The material of sole construction is generally known as Papermaker's Wet Felt. An example is AM FLEX2 ™ materials produced by Appleton Mills, Inc., Appleton, Wis. This woven "fabric" is manufactured in many thicknesses and compositions. For the sole material of the footwear of the invention the thickness is preferably 1/16 to ¼ inch, particularly ⅛ inch. The composition varies from 100% nylon to a mixture of synthetic fibers. Nylon is preferred. Its construction is specific in that the material is built around one or more woven core of base materials called scrim. Nylon fibers are layered in various thicknesses over and under the scrim. The layers are then bonded to one another by a "needle-punching" technique in which many thin nylon filaments are punched through the layers. The material used for the invention may have 1–3 scrim layers. Two-layered material is preferred. The result is a very strong but pliable woven material. A further preferred embodiment is that the material have a double layer of scrim and have two distinct machined directions on its surface.

The Papermaker's Wet Felt has certain properties which make it desirable as sole material for winter weather footwear. The most remarkable property is adherence to slippery winter walking surfaces, namely snow and ice. Another unique property is its non-conductivity of cold generated by ground and air conditions typical to any winter climate. The material is unaffected by soil, chemicals, petroleum products, detergents, or exposure to heat up to 160° F. Additionally, the "fabric" lends itself to ease in sewing and adhesive bonding. Abrasion due to normal winter walking conditions have proven negligible. Neither sharp ice formations, rough snow-packed edges, loose sharp gravel, nor gritty fine snow, sand, or salt crystals interfere with the gripping and thermal properties of the material. An even more remarkable characteristic shows itself when the fabric becomes moist or even soaking wet, which typifies a normal winter cycle of constant cooling and thawing. The non-slipping property of the material is in fact greatly increased when moisture due to thawing condition makes walking extremely hazardous.

It is believed that the superior traction properties of the Papermaker's Wet Felt material derive from its porous nature and its flat, fibrous surface. This is in contrast to what was apparently believed in the art to be necessary for winter footwear, i.e. waterproof materials and treaded surfaces. The sole material used in the novel footwear actually collects snow and ice within its fibers while being used. The theory, by which applicant does not intend to be bound, is that the snow and ice collected in the sole material adheres to the snow and ice on the ground surface when the footwear is stepped down on. The adherence of the snow and ice in the fibers of the sole material to the snow and ice on the ground creates a firm foothold. The principle on which this theory is based is that like materials attract each other and adhere well to each other. Applicant's invention applies this principle to snow and ice to provide high traction footwear for winter weather.

The unitary layer of sole piece is secured to the foot, boot or shoe of the wearer such that it covers the entire bottom of the footwear article and also extends up the sides, toe and heel to some extent. The extension of the sole up the sides, heel and toe allow for contact of the sole material with the ground surface when the surface is uneven or uneven steps are taken by the wearer. The sole piece can be secured to the foot, ankle and/or leg of the wearer or over a shoe or boot worn by the wearer by using elastic straps, VELCRO hooks and loops fasteners, snaps, drawstrings with fastening devices, laces, zippers, buckles, etc., and combinations of the above. For example, the sole piece can be secured over the foot, shoe or boot by the use of an elastic strap sewn around the circumference edge of the sole material which can be stretched to fit over the foot, shoe or boot, but, which tightens around the foot, shoe or boot when the stretching pressure is released. An adjustability feature can be added which consists of a strap around the back of the heel sewed to the circumference elastic strap on each side of the heel and fastened at varying tightness. Further, the sole piece could be secured by means of a drawstring threaded through holes in the circumference edge of the sole piece which can be adjusted with a fastener connected to both ends of the drawstring. Further, elastic straps or other fastenable straps, e.g., VELCRO hooks and loops fastener could extend from one side of the sole piece to the other over the top of the foot, shoe or boot, to hold it in place.

Particularly, a unitary nylon strap which has VELCRO loops on its surface at one end and VELCRO hooks on its opposing surface at the other end can be sewn underneath the above-discussed circumferential elastic strap, only around the heel area. The nylon strap which contains the VELCRO hooks and loops fasteners pass through D-rings or loops sewn or otherwise attached to the edge of the sole piece underneath the circumferential elastic strap on either side of the ankle portion of the footwear article. The ends of the nylon strap, which have the VELCRO hooks and loops areas on them, extend from underneath the elastic strap and over the top of the ankle portion of the footwear article such that they can be adjustably fastened to one another to secure the footwear article to the ankle of the wearer and also to tighten the footwear article over the heel of the wearer.

In a further embodiment of the invention the footwear article includes an insole positioned above the sole piece. The insole is comprised of a layer or multiple layers of closed-cell foam shock absorption and/or thermal insulation materials. For example, ENSOLITE ® materials obtainable from Uniroyal Plastics Company can be used. When multiple layers of these materials are used the bottom layer, closest to the sole, should be a thicker layer of more dense foam than the layers above it. A thicker, denser layer on the bottom provides support for the foot of the wearer, as well as, protection from rough ground surface conditions. Further, the closed-cell foam materials prevent moisture, which is present in the non-waterproof sole material, from raching the foot of the wearer. Preferably, two layers of closed-cell foam materials are used, the bottom layer being $\frac{1}{2}$ to $\frac{5}{8}$ inch thick and more dense than the top layer being $\frac{1}{4}$ to $\frac{3}{8}$ inch thick. The insole can further include a layer above the foam layers being a thin, soft pressed felt or other soft material, preferably less than $\frac{1}{4}$ inch thick. Alternatively, especially if the footwear article is worn as a complete boot over a sock or bare foot, a thin-formed cork insert layer can be used on top of the foam layers. The cork layer provides support for the foot of the wearer. BIRKENSTOCK ® brand cork inserts are an example of useful support materials. The various layers of the insole are bonded together on top of each other with an adhesive. Further, inserts of dense foam or other hard material can be placed in between layers of the insole to provide support for the arch or raising of the heel. The combination of bonded insole layers can be attached to the other parts of the footwear article, however, it is preferred to have it merely placed inside the sole.

The insole layers are formed such that there is created an indentation for the foot of the wearer which is generally the same shape and size as the foot. The indented portion can be formed by securing a hollow plastic tubing between two layers of the insole such that the tubing extends in a continuous fashion between the layers of insole roughly in the shape of the outline of the foot of the wearer, except larger. The insole, as a whole, extends outward significantly from the indented portion such that the surface area of the bottom flat surface of the insole is significantly larger than the surface area of the indented portion of the insole corresponding to the foot of the wearer. The oversize of the insole on the sides, heel and toe relative to the indented portion for the foot of the wearer enhances the traction properties of the footwear. The insole provides a structure around the bottom, sides, heel and toe of which the sole piece is positioned. Thus, the area of the sole which contacts the ground surface is correspondingly oversized with the bottom of the insole. The sole is also drawn in a rounded fashion around the side edges of the insole to extend up the sides of the article from where it contacts the ground surface. The overall impression of the oversized sole-insole combination is that of a padded paw, like an animal's paw. This combination provides a high surface area of contact of the sole with the ground surface. Higher surface area of contact relates directly to higher traction.

The pliability of the sole material coupled with the softness of the insole, relative to a hard rubber material, also adds to the overall impression as a large padded paw and gives the footwear article better traction through higher surface area of ground contact. The softness feature allows the sole of the footwear article to mold around irregularities on the ground surface, such as rocks or ice chunks, so that contact of the sole with the ground is not lost. Further, the insole and sole spread out to some extent when stepped on to provide high surface area.

The insole further provides insulation to the wearers foot from the cold of the ground surface. The closed-cell foam materials used to construct the insole provide good insulation and also prevent the moisture in the sole material from transferring to the foot. Further, the insole provides padding for the foot as a comfort feature. By the use of various layers of foam of varying thickness and density, as well as an optional cork insert and/or soft material layer and/or arch or heel inserts the comfort feature can be adjusted.

A final feature of the insole is the lack of an external raised heel portion. Without a raised heel, the footwear allows for "flatter" walking, i.e. less heel-to-toe walking. Better traction is obtained by flatter walking because more surface area of the sole is in contact with the ground for a longer time. The concentration of pressure in a small area which occurs in heel-to-toe walking is reduced to some extent by the absence of the raised heel.

The footwear article may further include an upper to cover the foot and, optionally, the ankle and/or portion of the leg of the wearer. The upper can extend to the knee or beyond. The upper can be made of any of a multitude of conventional materials. The major requirement for the upper material is that it have the property of breathability so that moisture is not trapped in the footwear article. Moisture in the footwear article will reduce its insulating ability and make the wearer's foot colder. Examples of materials for the upper are polar fleece, nylon pack cloth, wool, cotton, leather and any combinations of the above. The upper is preferably attached to the sole piece around the entire periphery of the sole piece which extends up the sides, heel and toe, of the footwear article. This can be accomplished by sewing the upper and the sole piece to an elastic strap or two elastic straps overlapping each other which extend around the entire circumferential edge of the sole piece. The upper can also be sewn directly to the sole piece on its inner surface around the entire circumference edge. The attachment of the upper to the sole piece also aids in positioning the sole piece around the sides, heel and toe of the footwear. The sole piece thus extends in a rounded fashion from the surface of the sole piece which normally contacts the ground to the point of contact with the upper. The placement and oversize of the insole also aid in forming a rounded and extending structure over which the sole piece is placed. as indicated above. The upper is held to the foot, ankle and/or leg of the wearer using conventional fastening means which are preferably adjustable. Examples of fastening means are elastic straps, VELCRO hooks and loops fasteners, snaps, drawstrings with fasteners, laces, zippers, buckles and combinations thereof. The fastening means could be on the outside or, totally or partially, on the inside of the footwear article. Further, the upper may be lined with any conventional type of insulating material, granting that it is breathable material.

A further feature of the invention is that all of the materials in combination result in a lightweight footwear article. The lightweight feature aids in the comfort of the footwear and also aids in its traction properties because less force is exerted onto the slippery surface.

Also, the footwear articles are easily washable, in a washing machine or otherwise, because of the porosity and lightweight materials used in their construction. If the footwear article includes an insole, this is preferably removed before washing and slipped back into position after drying.

The invention is illustrated in the attached drawings described below. However, it is understood that applicant's invention is not limited strictly to what is shown in the drawings.

DETAILED DESCRIPTION OF THE DRAWINGS

Figure 1:
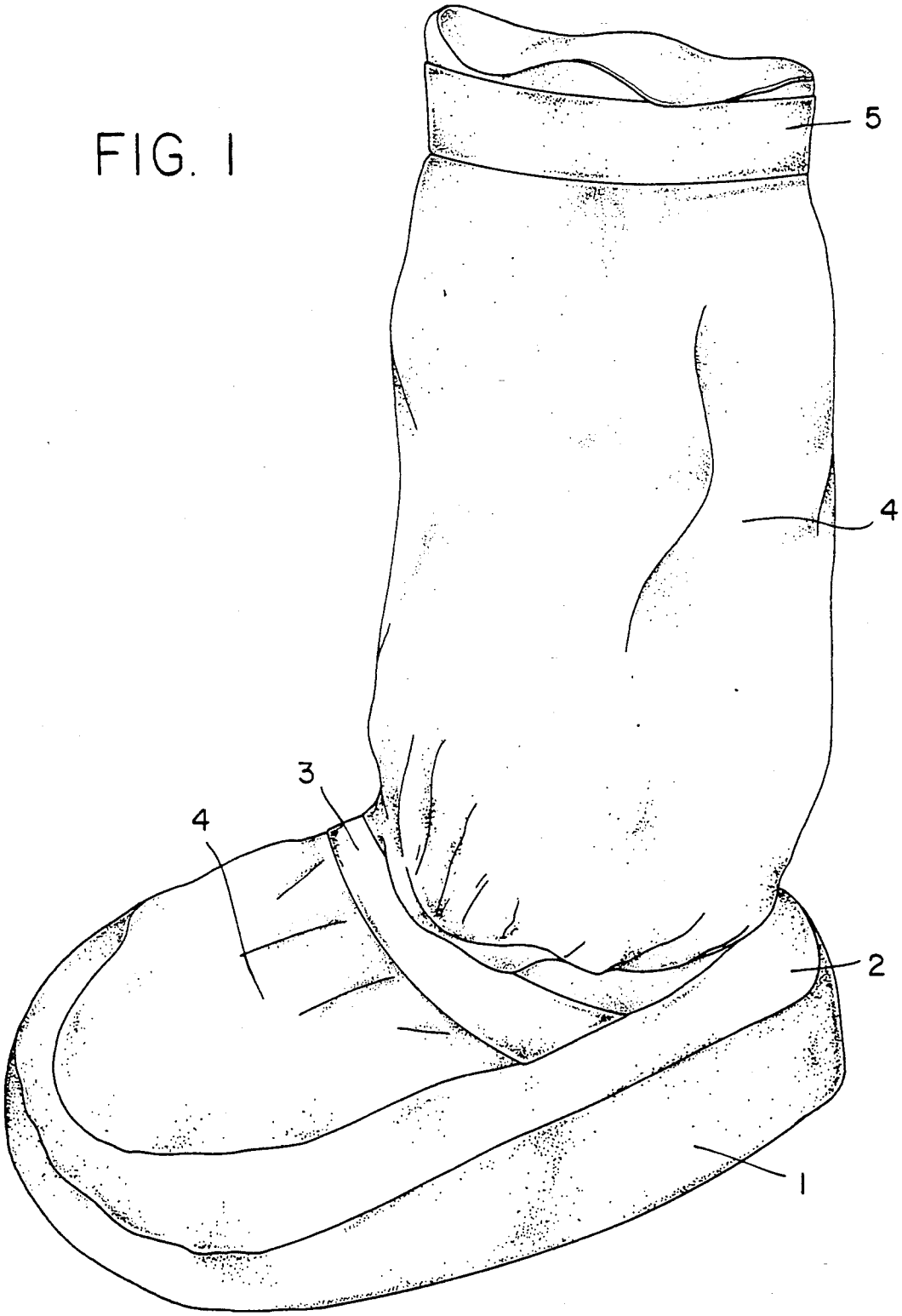
FIG. 1 is a boot or overboot or overshoe with calf-high cloth upper.

FIG. 1 shows a side view of a footwear article of the claimed invention which consists of a unitary sole piece 1 which is connected to an upper 4 by means of sewing both said sole piece and said upper to an elastic strap 2 which extends around the entire circumferential edge of the footwear article. The footwear article illustrated also includes an elastic strap 3 which extends from the circumferential edge of said sole piece under said circumferential elastic strip on one side to the circumferential edge of said sole piece under said circumferential elastic strap on the other side. This elastic strap extends over the ankle of the wearer to hold the foot into the footwear article. The footwear article illustrated also includes an elastic strap 5 around the circumference of the top of the upper which holds the upper onto the leg of the wearer.

Figure 2:
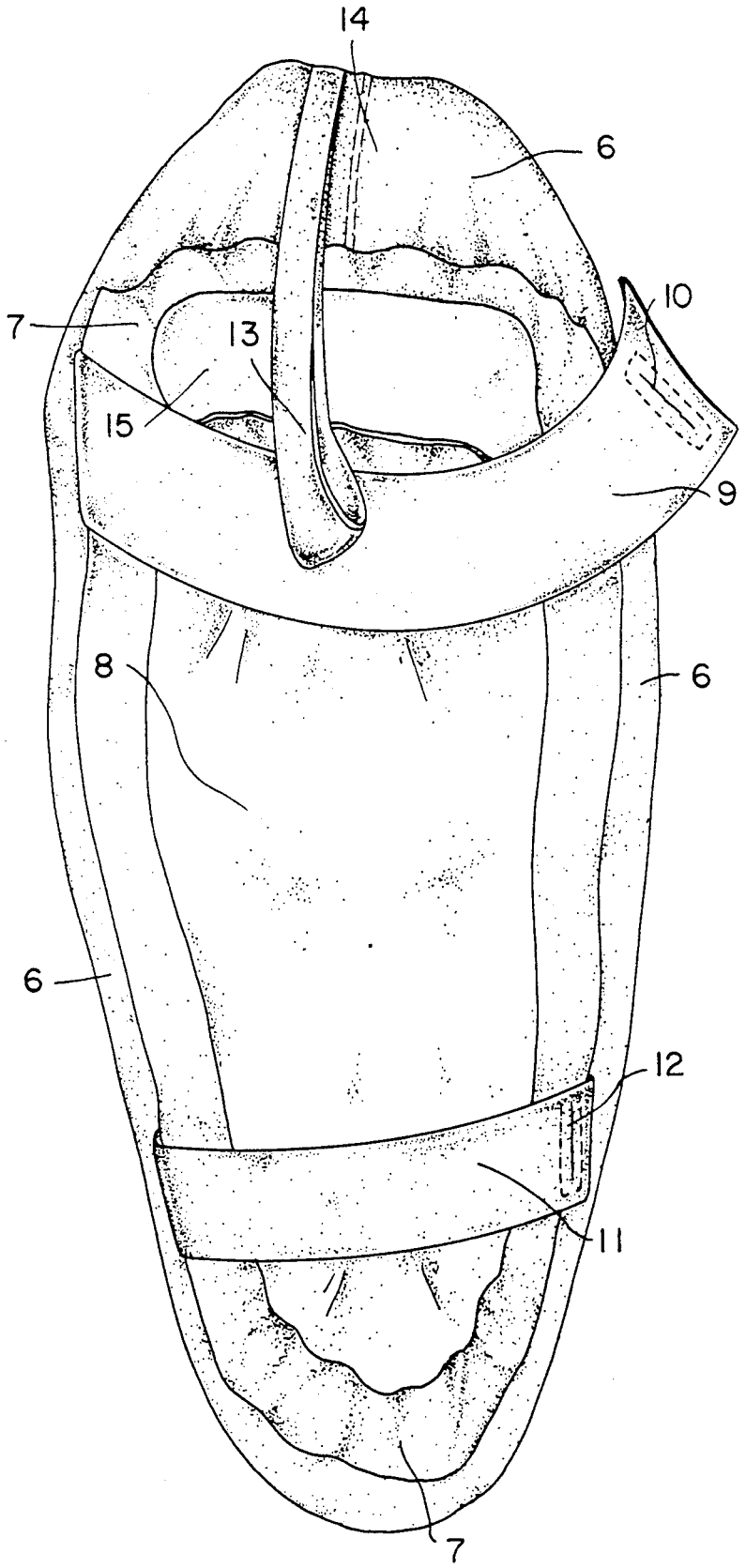
FIG. 2 is a top view of overshoe or overboot with ankle-high upper.

FIG. 2 is an illustration of the top view of the footwear article of the invention. The unitary sole piece 6 which extends around from the bottom surface is connected to an elastic strap 7 which extends around the circumferential edge of said sole piece, which is in turn attached to the upper 8. A strap 9, having a VELCRO hooks and loops fastener 10 extends from one side of the footwear article to the other, over the ankle area of the wearer. A second strap 11, with VELCRO hooks and loops fastener 12, extends from one side of the footwear article to the other over the toe area of the wearer. A strap doubled back and attached to itself and the heel area of the sole piece forms a loop 13 for pulling the footwear article on. A seam 14, where the unitary sole piece is cut and gathered around the heel extends up the back of the heel. The cavity 15 for the foot of the wearer is formed by the sole piece, elastic strap and upper.

Figure 3:
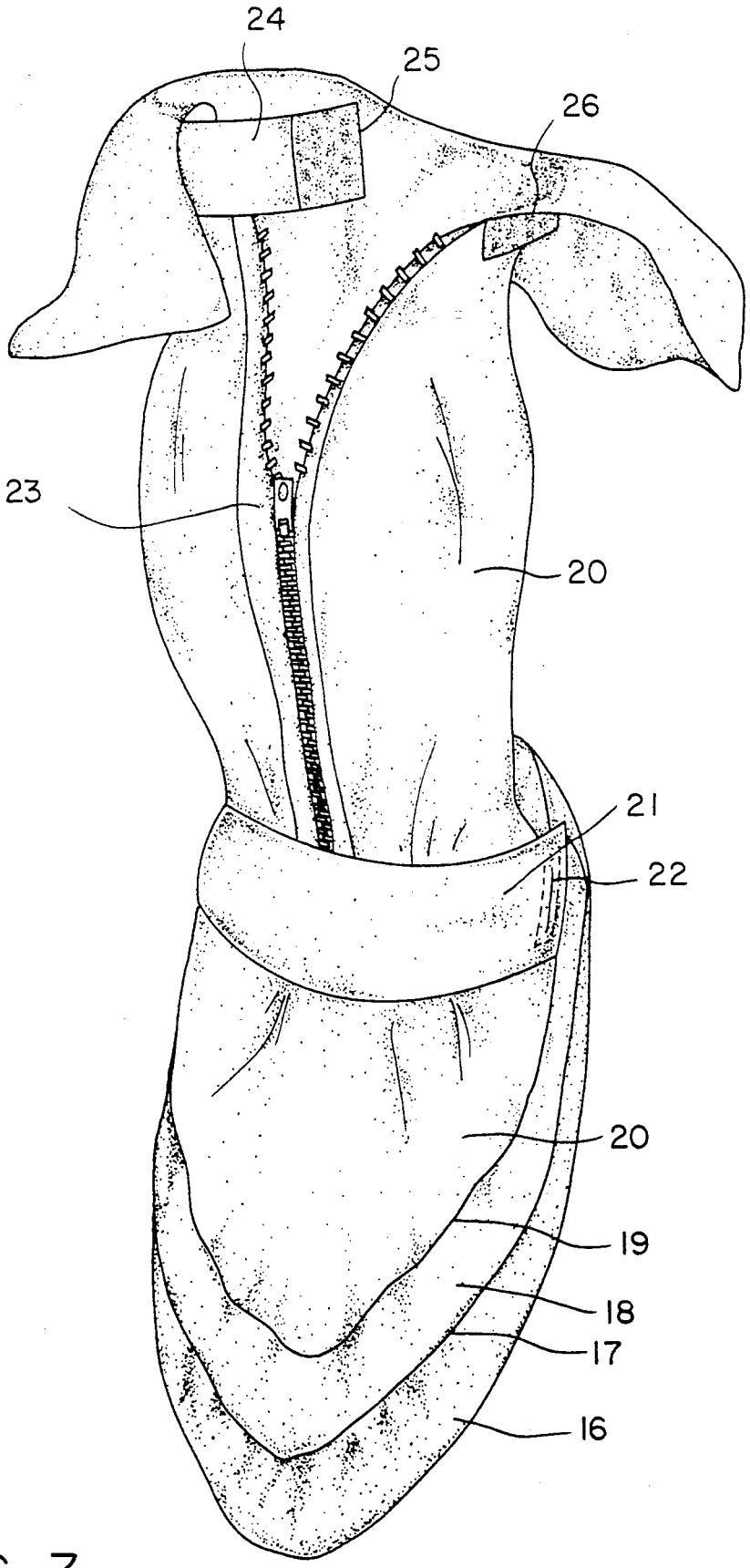
FIG. 3 is a front view of boot or overboot or overshoe with zippered calf-high upper.

FIG. 3 is a view from the top and front which illustrates a footwear article having a unitary sole piece 16 sewn by a seam 17 to an elastic strap 18 which is sewn by a seam 19 to an upper 20. The footwear article has a strap 21 extending from one side of the article to the other and fastened by velcro 22. The top part of the upper is openable via a zipper 23 and is secured around the leg of the wearer by a strap 24 having velcro hooks 25 on one end and velcro loops 26 on the other end.

Figure 4:
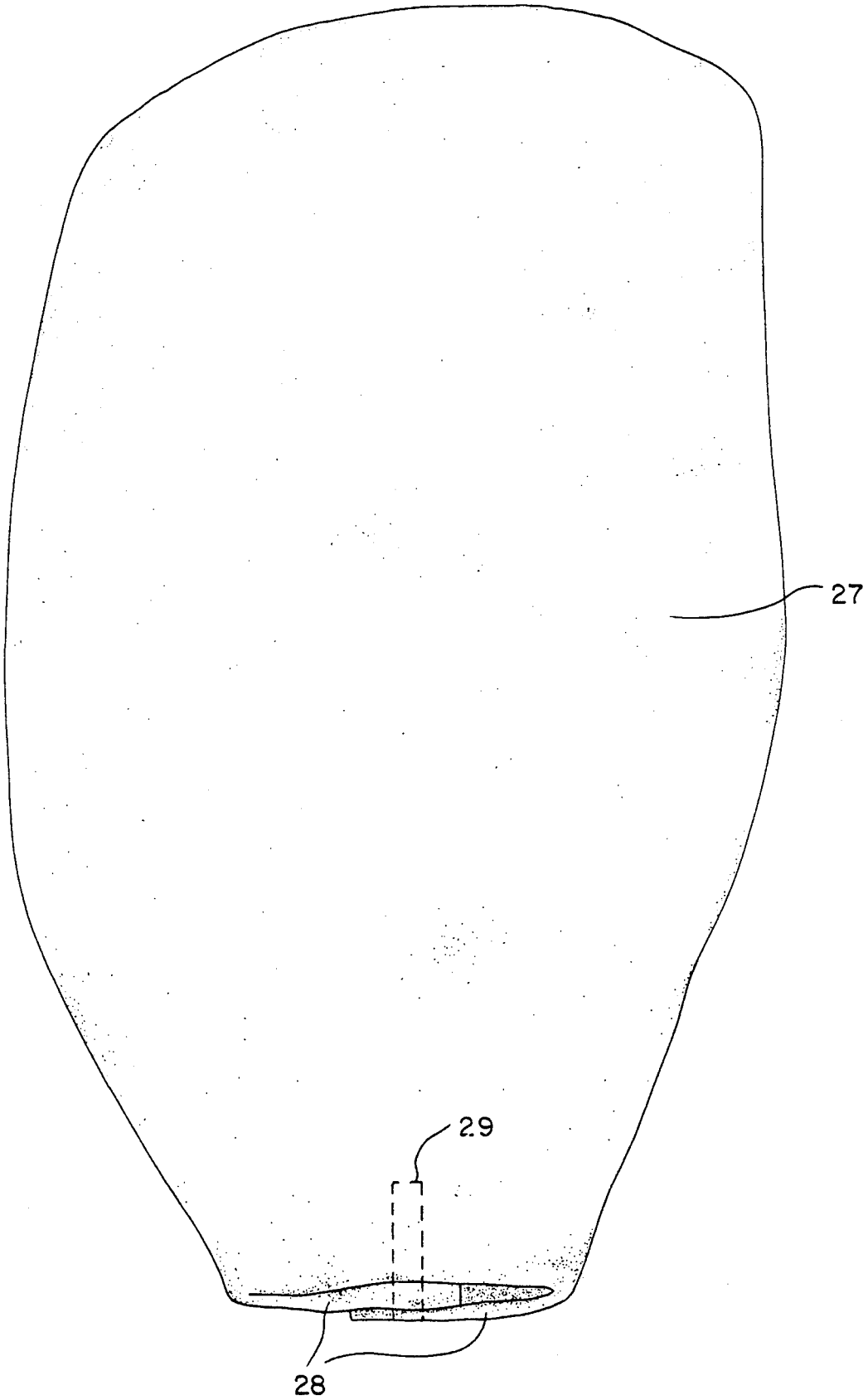
FIG. 4 is a bottom view of footwear article showing seam of sole material.

FIG. 4 is a view from the bottom of a footwear article of the invention. The unitary sole piece 27 is flat on the bottom and oversized in relation to the shape of the foot of the wearer. The unitary sole piece is cut to form flaps 28 which are sewn together along seams 29, which extend up the back of the heel, to form a heel portion of the sole piece.

Figure 5:
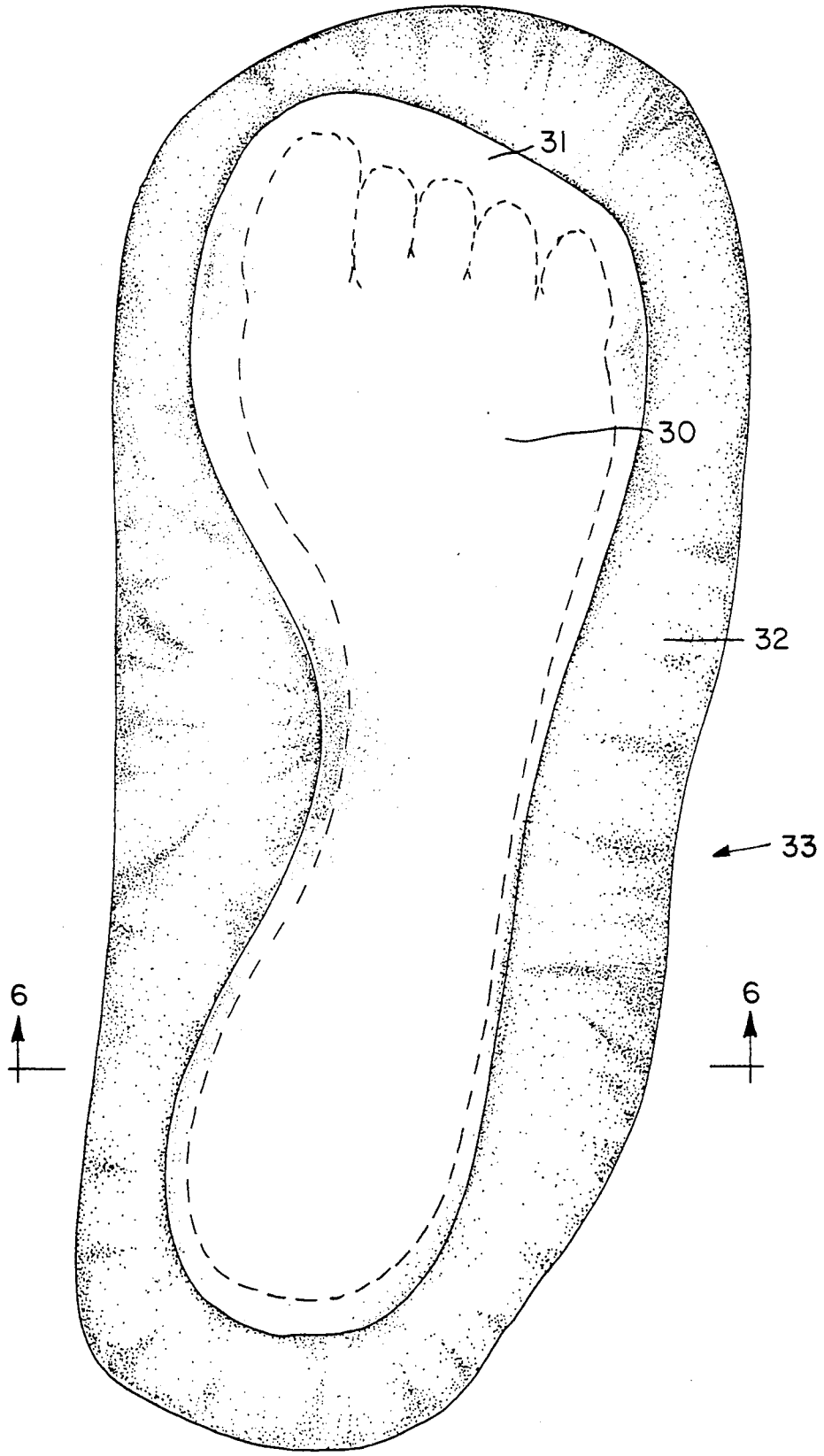
FIG. 5 is a top view of insole to be positioned inside footwear article.

FIG. 5 is a view from the top of an insole used in a footwear article of the invention. The drawing illustrates an indented portion 31 roughly in the form and size of the foot of the wearer 30 and an oversized insole 33 which has an extended portion 32 beyond the area of the wearer of the foot. The indented portion is formed within the sloping extended portion 32 of the insole.

Figure 6:
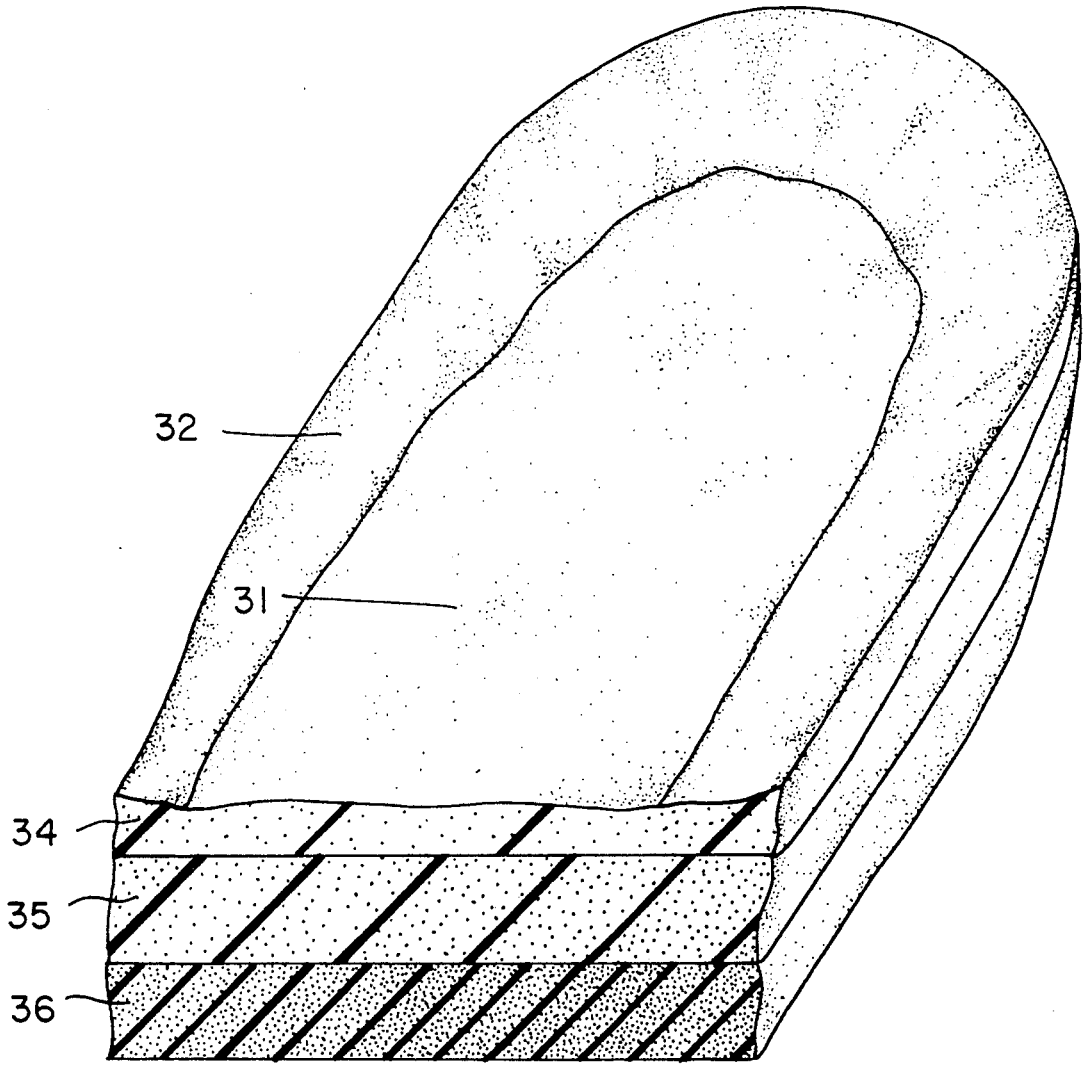
FIG. 6 is a cut-away view of insole along line 6—6 of FIG. 5, showing layers of insole.

FIG. 6 is a cut-away view of the insole along line 6—6 of FIG. 5. The drawing illustrates the indented portion 31 of the insole and the sloping and extending portion 32 of the insole. Three layers of the insole are shown in the cut-away. The top layer 34 is a thin layer of pressed felt or other soft material or a molded thin-formed cork insert. It should be noted that the surface of the indented portion 31 and the sloping and extended portion 32 are a unitary surface which surface is the top layer 34. The middle layer of the insole 35 is a closed-cell foam material which is less dense than the closed-cell foam material of the bottom layer 36 of the insole.

Figure 7:
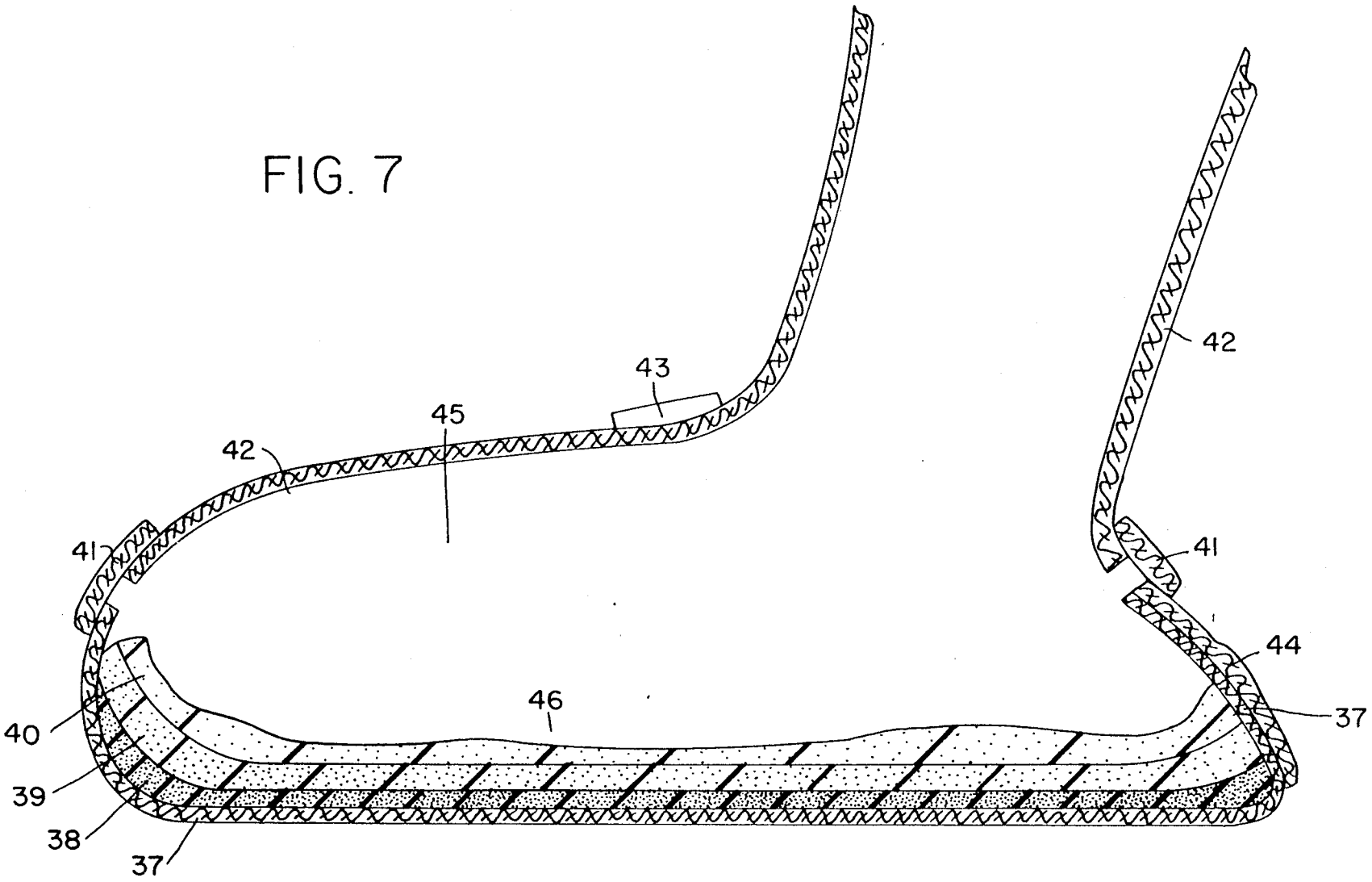
FIG. 7 is a cut-away side view of footwear article with layered insole and upper.

FIG. 7 is a cut-away side-view of a footwear article of the invention. Illustrated is the unitary sole piece 37 flat on the bottom, but extending up the toe and heel. The heel portion has a flap 44 which is part of the unitary sole piece, but was cut and folded over to create the heel portion. The extended heel area should be noted. The top, middle and bottom layers of the insole 40, 39 and 38 are positioned on the sole piece. The indented portion 46 of the insole for the foot of the wearer does not extend to the end of the insole as a whole either at the heel or toe. An elastic strap 41 is attached to the sole piece around its entire circumferential edge and is also attached to the upper 42 so that the upper and sole piece are connected. The strap 43 over the ankle portion holds the foot of the wearer in the footwear article. The cavity 45 formed by the sole piece, insole and upper is for the foot, boot or shoe of the wearer.

Figure 8:
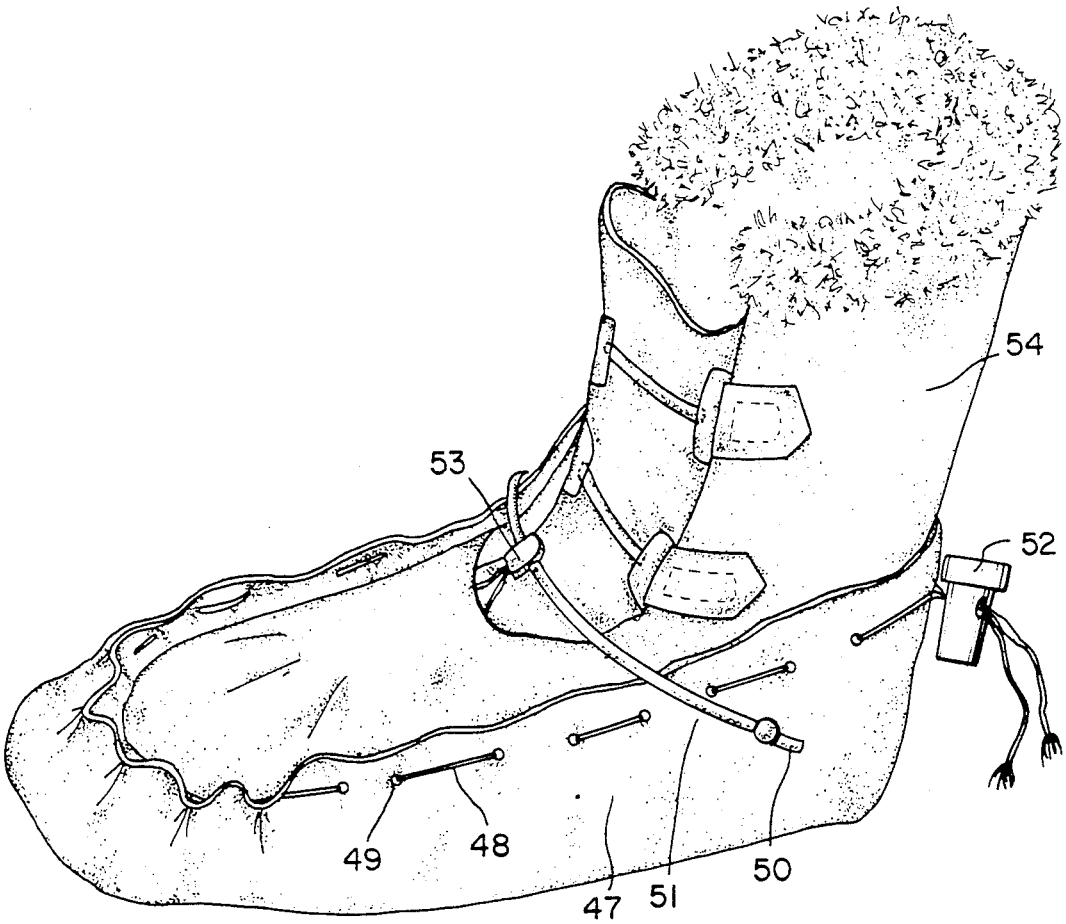
FIG. 8 is an overboot embodiment without insole or upper.

FIG. 8 illustrates an embodiment of the invention in which the footwear article has no insole or upper. The footwear article illustrated consists of a unitary sole piece 47 secured to an existing boot 54 (not part of the invention) by means of a drawstring 48 threaded around the circumferential edge of the sole piece through holes 49. The ends of the drawstring are gathered in a barrel tension clip 52 by which it can be adjusted. Further, a rivet and clip 50 is attached to each side of the sole piece through which a second drawstring 51 is passed. The second drawstring is adjusted by adjuster 53.

Figure 9:
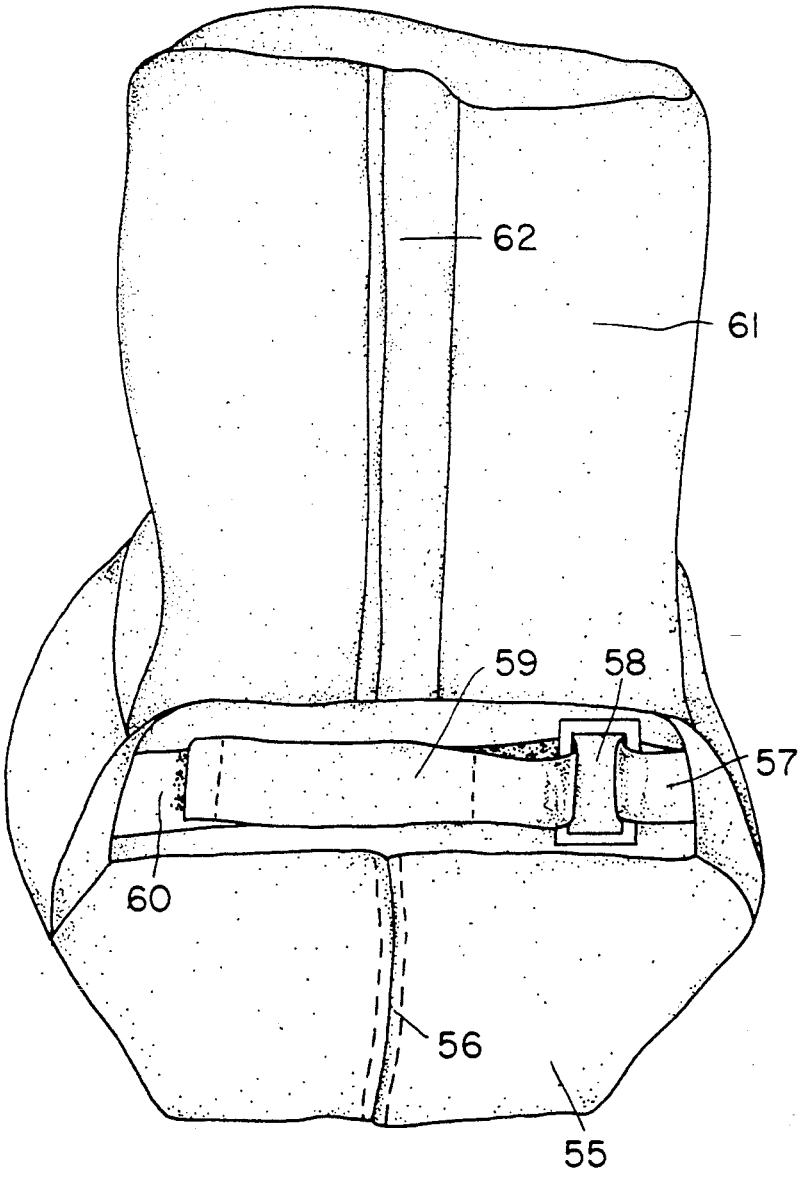
FIG. 9 is a back view of footwear article showing adjustable heel strap and sole seam.

FIG. 9 is a view from the back of a footwear article of the invention. It illustrates the sole piece 55 and seam 56 formed by cutting a slot in the sole piece and folding it over to form the heel portion. The footwear article has a means for tightening down the heel which consists of a strap 57 attached on one side of the heel and also attached to a D-ring 58. Another strap 60 attached to the other side of the heel is slipped through the D-ring and fastened back on itself by VELCRO hooks and loops fastening 59. The seam 62 of the upper 61 is also illustrated.

Figure 10:
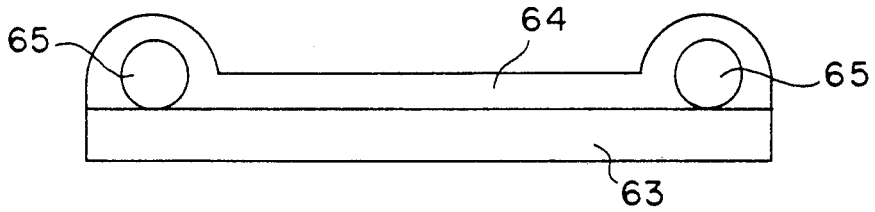
FIG. 10 is a cut-away view of the insole showing layers of insole and plastic tubing forming indented portion.

FIG. 10 is a cut-away view of a two-layered insole. Secured between the bottom layer 63 and the top layer 64 is plastic tubing 65 which acts to raise the outer edge of the top layer.

Figure 11:
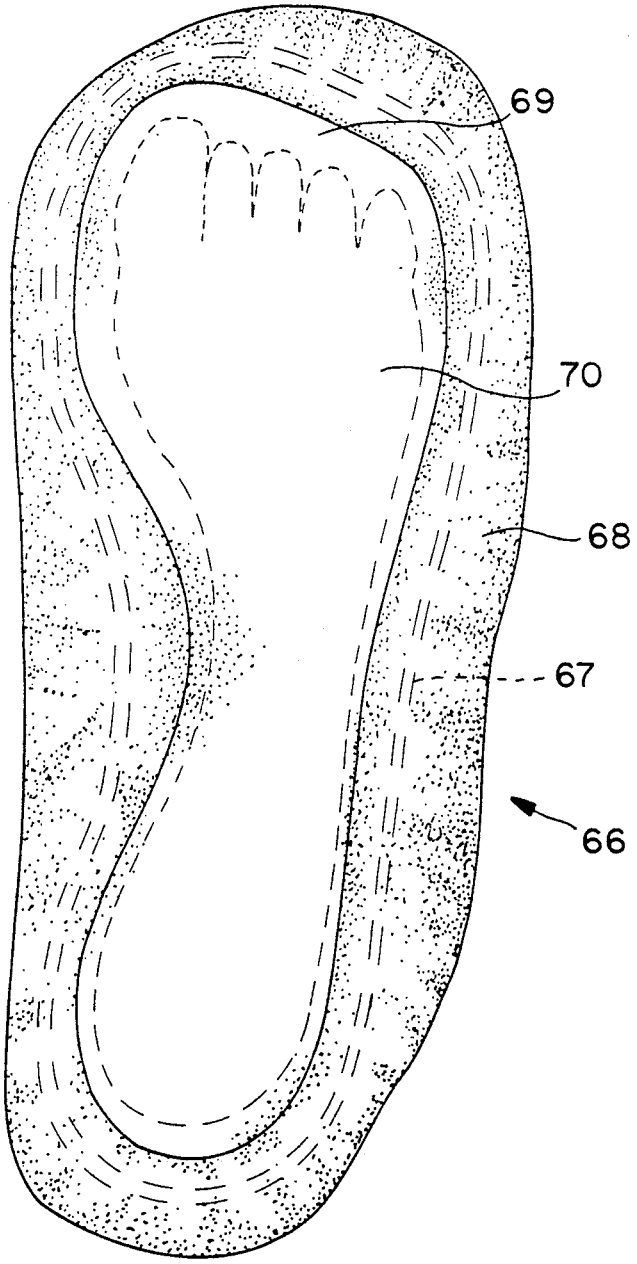
FIG. 11 is a top view of the insole which shows the plastic tubing to create the indented portion.

FIG. 11 is a view from the top of an insole 66 which has plastic tubing 67 underneath the top layer of insole to create a raised portion of the insole 68 around the outer edge and an indented portion 69 for the foot of the wearer 70.

I claim:

1. A winter weather footwear article comprising a single sole piece, an over-sized insole and means for removably securing and, optionally, adjustable tightening said article to the wearer, wherein said single sole piece consists of a layer of synthetic felt material woven by a needle punch technique, which is porous, breathable and pliable, and wherein said single sole piece covers the entire bottom surface of said footwear article and wherein said over-sized insole comprises at least one layer of closed-cell foam material which has an indented portion on the top of the insole roughly in the shape of the bottom of the shoe or boot over which the footwear article is worn, which has a flat heel, and which significantly extends outside the indented area on the sides, heel and toe such that the surface area of the bottom of the insole, which is flat, is significantly greater than the surface area of the indented portion; wherein said insole is placed inside, and optionally attached to, the inner surface of the sole piece in a manner such that the sole piece layer covers the entire bottom of the insole and, also, wraps around the side of the insole at the sides, heel and toe such that the sole piece takes on a concave shape and the surface area of the sole piece which contacts the surface when worn is significantly greater than the surface area of said indented portion.

2. The footwear article of claim 1, wherein the insole comprises 2 or more layers of different types of closed-cell foam material attached together.

3. The footwear article of claim 2, wherein the layers of closed-cell foam material are progressively more dense and thicker from the top layer to the bottom layer.

4. The footwear article of claim 1, wherein the insole has two layers of closed-cell foam material, the bottom layer being $\frac{1}{2}$ to $\frac{5}{8}$ inch thick, the top layer being $\frac{1}{4}$ to $\frac{3}{8}$ inch thick, and the bottom layer being of denser foam than the top layer.

5. The footwear article of claim 1, wherein the insole further comprises a layer less than $\frac{1}{4}$ inch thick on top of the top foam layer which is a soft material.

6. The footwear article of claim 1, wherein the insole further comprises a thin-formed cork insert layer molded to support the foot of the wearer, on top of the foam materials and in the indented portion, which is formed to support the foot of the wearer.

7. The footwear article of claim 1, which further comprises an upper of a breathable material which is attached to the sole piece such that it encloses the top of the shoe or boot on which the footwear article is worn and, optionally, extends to enclose the ankle and part of the leg of the wearer.

8. The footwear article of claim 7, wherein the upper is attached to the sole piece in a manner such that it is firmly attached around the entire circumference of the sole piece.

9. The footwear article of claim 8, wherein the upper and the sole piece are sewn to an elastic strap which extends around the circumference edge of the sole piece.

10. The footwear article of claim 8, wherein the upper is of a material selected from the group consisting of the polar fleece, nylon pack cloth, wool, cotton, leather and combinations thereof.

11. The footwear article of claim 7, wherein the upper is adjustably secured to the wearer by elastic straps, hooks and loops fasteners, snaps, drawstrings with fasteners, laces, zippers, buckles or combinations thereof either on the inside or outside of the footwear article.

12. The footwear article of claim 1, wherein the sole piece extends $\frac{1}{4}$ to 2 inches from the bottom over the sides, heel and toe of the shoe or boot.

13. A footwear article as defined in claim 1, wherein the single sole piece is 1/16 to $\frac{1}{4}$ inch thick.

14. A footwear article as defined in claim 1, wherein the sole piece is woven from nylon material.

15. A footwear article as defined in claim 1, wherein the sole piece is a woven double layer of synthetic felt having two distinct machined directions on its surface.

16. A footwear article as defined in claim 15, wherein the single sole piece is $\frac{1}{8}$ inch thick.

17. The footwear article of claim 1, which further comprises a strap attached to form a loop on the back of the heel of the footwear article.

18. The footwear article of claim 1, wherein the indented portion of the insole is formed by the attachment of a length of plastic tubing between two layers of the insole around the outer edge to raise the outer edge of the insole, thus creating the indented portion.

* * * * *

UNITED STATES PATENT AND TRADEMARK OFFICE

CERTIFICATE OF CORRECTION

PATENT NO. : 5,150,536

DATED : September 29, 1992

INVENTOR(S) : Molly Strong

It is certified that error appears in the above-identified patent and that said Letters Patent is hereby corrected as shown below:

| COLUMN | LINE | |
|---|---|---|
| 2 | 4 & 5 | "AM FLEX2 T-M" should read --AM FLEX2™-- |
| 6 | 48 | "velcro 22" should read --VELCRO hooks and loops fastners-- |
| 6 | 50 & 51 | "velcro" should read --VELCRO-- (in both instances) |
| 7 | 68 | "at least one" should read --a-- |

Signed and Sealed this

Thirtieth Day of November, 1993

Bruce Lehman

*Attest:*

BRUCE LEHMAN

*Attesting Officer*

*Commissioner of Patents and Trademarks*